United States Patent [19]

Ballard

[11] Patent Number: 4,850,852

[45] Date of Patent: Jul. 25, 1989

[54] GAS VALVE SHUT OFF METHOD AND APPARATUS

[75] Inventor: Gary W. Ballard, Indianapolis, Ind.

[73] Assignee: Carrier Corporation, Syracuse, N.Y.

[21] Appl. No.: 156,158

[22] Filed: Feb. 16, 1988

[51] Int. Cl.[4] ..... F23N 5/20

[52] U.S. Cl. ..... 431/6; 431/18; 431/20; 431/27; 431/29; 431/31

[58] Field of Search ..... 431/24, 18, 6, 19, 45, 431/29, 31, 26, 13, 27, 20, 89; 126/116 A

[56] References Cited

U.S. PATENT DOCUMENTS

| | | | |
|---|---|---|---|
| 2,704,571 | 3/1955 | Reichelderfer | 431/19 X |
| 3,954,383 | 5/1976 | Bryant | 431/24 |
| 4,278,419 | 7/1981 | Bechtel et al. | 431/24 |
| 4,298,334 | 11/1981 | Clark et al. | 431/45 X |
| 4,403,942 | 9/1983 | Copenhaver | 431/26 X |
| 4,412,328 | 10/1983 | Homa | 431/24 X |
| 4,518,345 | 5/1985 | Mueller et al. | 431/29 X |
| 4,695,246 | 9/1987 | Beilfoss et al. | 431/31 X |

*Primary Examiner*—Robert E. Garrett
*Assistant Examiner*—Carl D. Price
*Attorney, Agent, or Firm*—Dana F. Bigelow

[57] ABSTRACT

Provision is made for sensing when the gas valve relay contacts are welded, or stuck, in the closed position and for responsively turning off the inducer motor when that occurs. This in turn causes the pressure switch to open to thereby cut off the power to the gas valve and cause it to move to the closed position.

9 Claims, 2 Drawing Sheets

GAS VALVE SHUT OFF METHOD AND APPARATUS

BACKGROUND OF THE INVENTION

This invention relates generally to gas furnaces and, more particularly, to a method and apparatus for detecting a fault condition in a gas valve relay and for responsively closing the gas valve by shutting off the power thereto.

In the operation of gas fired furnaces, it is imperative that the flow of gas be closely controlled so as to be coordinated with the other related functions that support the combustion process. That is, to ensure the safe and efficient operation of an induced draft furnace, it is important to precisely control the sequence and timing of each step of the heating cycle wherein, typically, the inducer motor is turned on to purge the system, the ignitor is turned on and allowed to warm up, the gas valve is turned on to initiate ignition, a sensor is caused to function to ensure that a flame does exist, and finally, the circulating air blower is turned on to provide the flow of hot air to the space to be heated. When the set temperature of the thermostat has been satisfied, the gas valve and inducer motor are turned off and then, after an appropriate delay period, the circulating air blower is turned off.

The gas valve in such a system is typically opened and closed by way of an electromechanical relay which selectively turns on or turns off power to the gas valve by way of the closing or opening of power contacts by way of the control circuit. Generally, the relay contacts are designed so that if the relay is operated within its specified operating conditions, the relay will provide reliable operation without the occurrence of failure. However, in the event that abnormal operating conditions should occur, such as, for example, a power line braking in an ice storm to thereby cause power surges to travel through the line to the control, a welding of the relay contact to the closed position could occur. This, in turn, would cause the gas valve to remain open when it should later be closed. For example, if the system is operating with the power contacts closed and the gas valve on during the occurrence of such a power surge, and as a result the contacts are welded closed, then at the end of the heating cycle the control system will turn off the inducer and will try to turn off the gas by operation of the relay. But since the contacts are welded close, the gas valve will remain open. Without combustion air being supplied by the inducer, the combustion process will be inhibited and a buildup of gas will result. This may in turn cause an undesirable flame roll out with possible resulting damage to the furnace.

A common technique for protecting against such a fault is to provide a fuse in series with the power contacts. When a relay contact failure has been detected, an auxiliary circuit is turned on to thereby draw sufficient current to burn out the fuse, thus opening the electrical circuit to cut off power to the gas valve. The existence of a fuse in the circuit, however, can become a nuisance. For example, if the fuse fails due to fatigue, as they frequently do, or if a short circuit is accidentally caused during servicing of the unit, the fuse will be caused to burn out, and the system will be inoperable until the burned out fuse is detected and replaced, a process which may be inconvenient and costly to the owner.

It is therefore an object of the present invention to provide an improved control system for a gas fired furnace.

Another object of the present invention is the provision in a gas fired furnace for safely and reliably dealing with the occurrence of a gas valve relay fault.

Yet another object of the present invention is the provision in a gas fired furnace for eliminating the use of a fuse in the power line to the gas valve.

Still another object of the present invention is the provision in a gas fired furnace for dealing with the problem of welded relay contacts without the use of a fuse and associated auxiliary circuitry.

Yet another object of the present invention is the provision in a gas valve control system which is economical to manufacture and effective and safe in use.

These objects and other features and advantages become more readily apparent upon reference to the following description when taken in conjunction with the appended drawings.

SUMMARY OF THE INVENTION

Briefly, in accordance with one aspect of the invention, provision is made to use existing components in order to turn off the gas valve of a gas fired furnace when the contacts of the associated relay are accidentally welded shut. When this condition is sensed, the control system acts to turn off the induced draft blower in the system. This will in turn cause a decrease of pressure in the combustion air duct, and the pressure switch will open. In this way, power to the gas valve will be turned off and the ga valve will automatically come to the closed position.

By another aspect of the invention, the occurrence of a fault condition is sensed by sensing a voltage across the relay contacts which are susceptible to the welding phenomena. When the voltage is determined to be there at the incorrect sequence in time, then the control system is prompted to turn off the inducer motor relay. The pressure switch then responsively opens to turn off the power to the gas valve.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
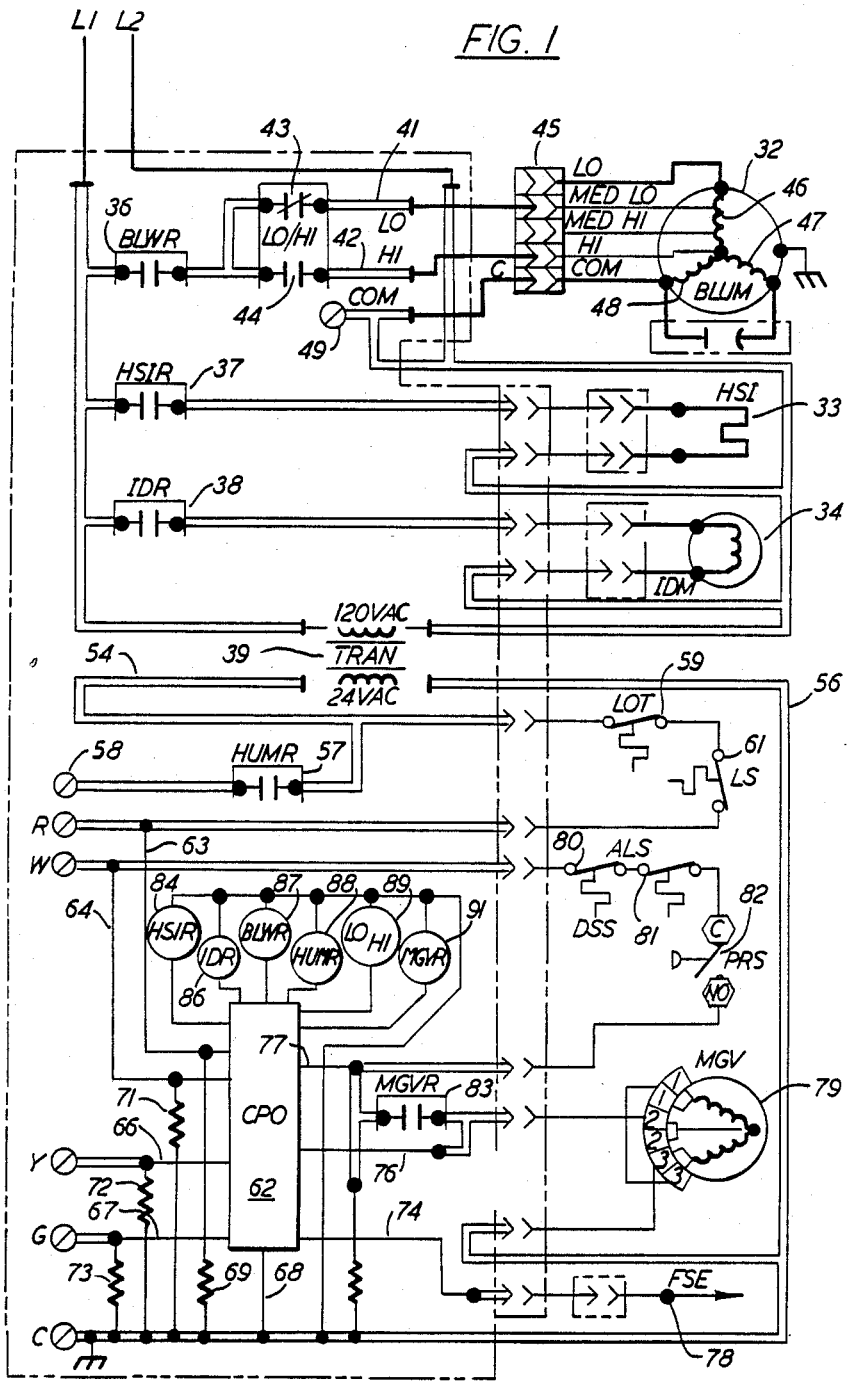
FIG. 1 is a schematic illustration of a furnace control system having the present invention incorporated therein.

Referring now to FIG. 1, the various components of an induced draft gas furnace are shown together with their controlling circuitry which is adapted to operate in accordance with the present invention. A circuit board indicated by the broken lines, is provided with line voltage by way of leads L1 and L2. Power is thereby provided to a circulating air blower motor 32, a hot surface igniter 33, and an induced draft blower motor 34 by way of relays 36, 37 and 38, respectively. Power is also provided to the control portion of the circuit board by way of a low voltage stepdown transformer 39.

Included in the circuit supplying power to the blower motor 32, in addition to the relay 36, are parallel leads 41 and 42 which provide for low and high speed connections, respectively, and a single pole, double throw relay with the low speed lead 41 having normally closed relay contacts 43 and the high speed lead 42 having normally open relay contacts 44. Both the low speed lead 41 and the high speed lead 42 are connected by way of a five circuit connector 45 to one leg 46 of the Wye connected blower motor 32, with the other legs 47 and 48 being connected via the connector 45 to a common terminal 49. Thus, by selectively choosing the desired connector 45 terminals to be used, and by controlling the relay contacts 43 and 44, the blower motor 32 can be selectively caused to operate at either of the selected levels of low or high speeds.

Referring now to the control or bottom portion of the circuit, low voltage power is provided from the secondary coil of the transformer 39 to the conductor 54 and to the conductor 56, which is connected to the common terminal C. The conductor 54 is electrically connected through normally open relay contacts 57 to a terminal 58 which can be connected to provide power to auxiliary equipment such as a humidifier (not shown), and also to a circuit which includes a manually resettable limit switch 59 sensitive to overtemperature, an automatic resettable limit switch 61 sensitive to overtemperature, and the terminal R.

In addition to the conventional connections as discussed hereinabove, the R, W, Y, G, and C terminals of the circuit board 31 are connected in a conventional manner to the room thermostat (not shown). However, unlike the conventional circuit without microprocessor control, each of those terminals is connected to a microprocessor 62 by way of leads 63, 64, 66, 67, and 68, respectively. Load resistors 69, 71, 72 and 73 are provided between the common terminal C and the respective terminals R, W, Y and G to increase the current flow through the circuits to thereby prevent the occurrence of dry contacts.

Other inputs to the microprocessor 62 are provided along lines 74, 76 and 77. The line 74 is connected to a flame sensing electrode 78 to provide a signal to the microprocessor to indicate when a flame has been proven to exist. Lines 76 and 77 provide other indications as will be discussed hereinafter.

Power to the main gas valve 79 is received from the terminal W by way of a draft safeguard switch 80, an auxiliary limit switch 81, a pressure switch 82 and the normally open relay 83. The microprocessor 62 is made aware of the condition of the auxiliary limit switch 81 and the pressure switch 82 by way of signals received along line 77. The line 76 is connected to the output of the relay 83 and provides voltage level signals to indicate to the microprocessor 62, whether the gas valve should be on or off.

Having described the circuits that are controlled by the microprocessor 62 through the use of relays, the controlling outputs of the microprocessor 62 will now be briefly described. The hot surface ignitor output 84 operates to close the relay contacts 37 to activate the hot surface igniter 33. The inducer motor output 86 operates to close the relay contacts 38 to activate the inducer motor 34. The blower motor output 87 operates to close the relay contacts 36 to activate the blower motor 32. The humidifier output 88 operates to close the relay contacts 57 to activate the humidifier. The low/high relay output 89 operates to open the relay contacts 43 and close the relay contacts 44 to switch the blower motor 32 from low to high speed operation. Finally, the main gas valve output 91 operates to close the relay contacts 83 to open the main gas valve 79.

Considering now the operation of the control apparatus during a typical heating cycle, the sequence of operation will be as follows. When the all thermostat calls for heat, the R and W circuits are closed. The microprocessor 62 checks the inputs and outputs and energizes the inducer relay 38 to start the inducer motor 34 and initiate the process of purging the system of unwanted gas. As the inducer motor 34 comes up to speed, the pressure switch 82 closes, and after a predetermined period of time, the microprocessor 62 activates the hot surface ignitor relay 37 to provide power to the hot surface ignitor 33. After a warm-up period of a predetermined time, the microprocessor 62 activates the main gas valve relay 83 to provide power to and turn on the main gas valve 79. As soon as a flame is sensed by the flame sensing electrode 78, the microprocessor 62 deactivates the hot surface ignitor 37, and holds the main gas valve on so long as the flame is present or until the thermostat is satisfied. When the thermostat is satisfied, the R and W circuits are de-energized to thereby de-energize the main gas valve 79, and, after a post-purge period, the inducer motor 74.

Figure 2:
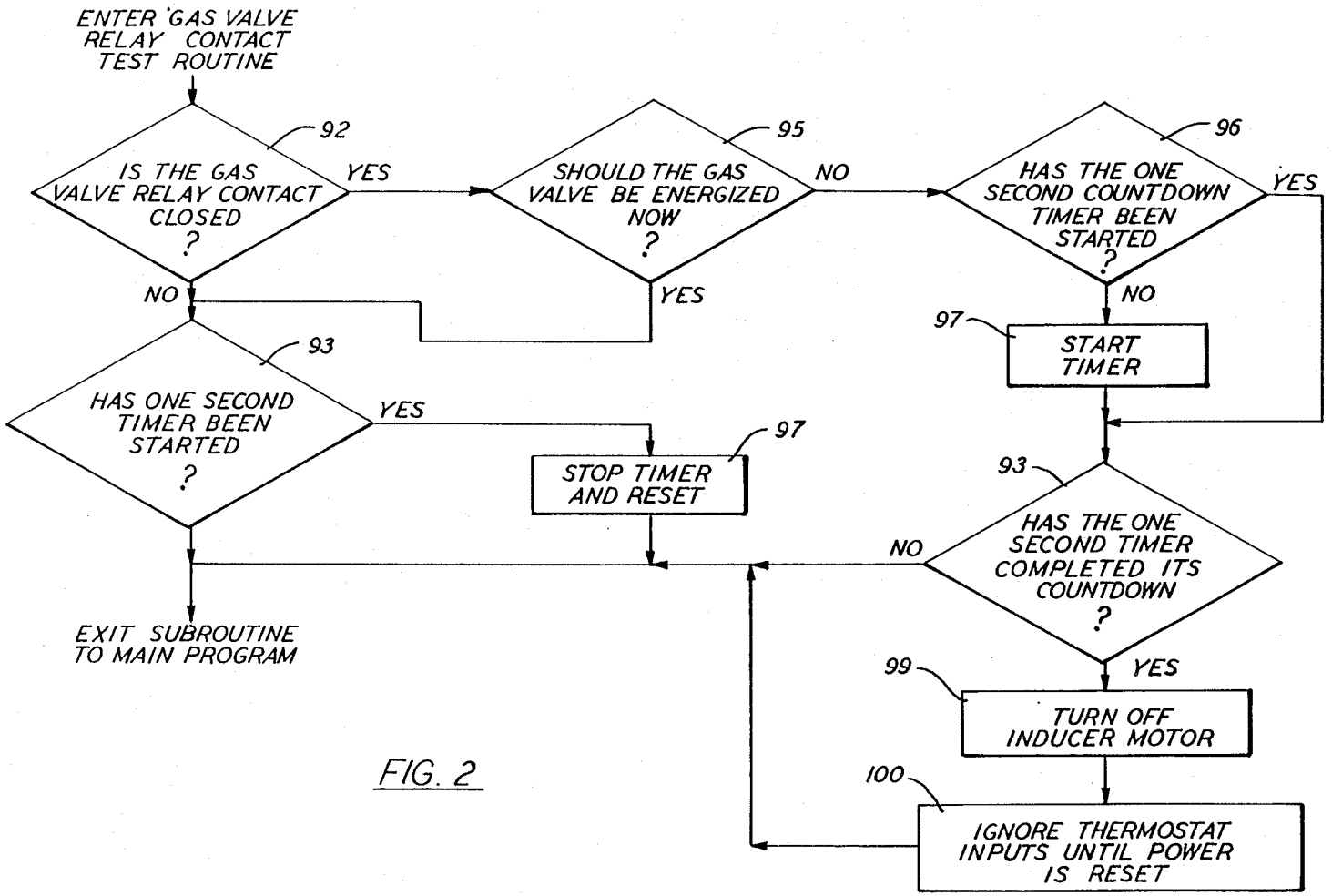
FIG. 2 is a flow diagram showing the operation of the present invention.

Assume now that the thermostat has called for heat and that the system has responsively cycled through the step of turning on the inducer motor 34, as soon as pressure builds up, pressure switch 32 closes. If gas valve relay 83 has failed in the closed position or the components used by microprocessor 62 to energize gas valve relay 83 have failed in a manner to cause the relay to close its contact prior to receiving the microprocessor signal to do so, then the microprocessor will at this time sense voltage on line 76, prior to its sending a signal out to gas valve relay coil 91. With the gas valve relay contact 83 closed ahead of the microprocessor's desired sequence, gas will start flowing immediately before the purge and ignitor warm-up periods have been completed, thus possibly creating a hazardous condition. Likewise, if the gas valve relay contact should close any time during the purge period, ignitor warm-up period and post purge period, prior to the time when microprocessor 62 energized the gas valve relay 91, the microprocessor can detect this condition by sensing voltage on line 76. The fact that it is there out of its normal sequence causes the microprocessor to shut off the inducer motor 34 which causes pressure switch 32 to open, removing voltage from gas valve and line 76. At the same time, the microprocessor goes into a routine called lockout, which prevents it from responding to any further input commands until it is reset. The gas valve relay contact test routine of the present invention is designed to perform this function as described above and as further shown in FIG. 2.

In block 92, the microprocessor 62 queries the system to determine whether the gas valve relay contact 83 is closed. This is accomplished by measuring the voltage thereacross by way of line 76 as described hereinabove. If no voltage is sensed on line 76, then the indication is that the relay contact is not closed and the process steps to block 93 where provision is made to step to block 94 to stop and reset the timer if it has been started, and to then exit the subroutine and return to the main program.

If, in block 92, it is determined that the gas valve relay contacts are closed, as will be evidenced by a voltage on line 76, then the routine proceeds to block 95 to determine whether or not the gas valve 79 should be energized. This determination can be made, for example, by determining whether the system is operating in the heating mode routine (i.e. is the thermostat in fact calling for heat and that the main gas valve output 91 from the microprocessor 62 is calling for the relay contacts 83 to be closed). Thus, if the thermostat is indeed calling for heat and the gas valve relay output 91 is calling for the relay contacts 83 to be closed, then the program proceeds to block 93 and then back to the main program.

If it is determined that the thermostat is not calling for heat, and that the main gas valve relay output 91 is not calling for the relay contacts 83 to be closed, then the program steps to blocks 96 and 97 to provide a one second delay to allow the relay contacts to open if the system is indeed operating properly. Once that delay period has been provided as indicated by block 98, then the system proceeds to block 99 where the microprocessor initiates the proper signals to turn off the inducer motor. This will in turn cause a decrease of pressure in the combustion air duct and the pressure switch 82 will responsively open to thereby cut off the power which is flowing to the main gas valve 79 by way of the relay contacts 83. With no power to the gas valve 79, it will then automatically come to the closed position to shut off the gas and therefore avoid any conditions of excess heating. The step in block 100 ensures that the control system ignores any further input signal from the thermostat until power is reset.

While the present invention has been disclosed with particular reference to a preferred embodiment, the concepts of this invention are readily adaptable to other embodiments, and those skilled in the art may vary the structure and method thereof without departing from the essential spirit of the present invention.

What is claimed is:

1. An improved method of controlling a gas furnace of the type having an inducer and a pressure switch responsive to the output thereof to supply power to a gas valve by way of relay contacts adapted to be selectively closed by a controlled actuator comprising the steps of:

determining when power is being provided through the relay contacts;

determining if, at the same time, the actuator is in such a condition as to cause closure of the relay contacts; and if power is being provided through the relay contacts at a time when the actuator is not in such a condition as to cause closure of the relay contacts, turning off the power to the inducer so as to thereby cause the pressure switch to open and remove power from the gas valve.

2. A method as set forth in claim 1 wherein said step of determining when power is being provided across the relay contacts is accomplished by way of sensing the voltage across the contacts.

3. A method as set forth in claim 1 wherein said step of determining when the actuator is in a condition to cause closure of the power contacts includes the step of determining whether heat is being called for.

4. In an induced draft furnace of the type having an inducer for providing combustion air to a burner, a gas valve which is selectively actuated with power through power contacts of a relay, and a pressure switch responsive to the amount of air provided by the inducer to connect the power to the power contacts, an improved control system comprising:

actuation means for selectively operating the relay to selectively open or close the power contacts;

comparison means for determining when a fault condition exists because of said power contacts being closed at a time when said actuation means is in a condition wherein the power contacts should be open; and switching means responsive to said comparison means to turn off said inducer when a fault condition exists such that the pressure switch is then opened and power to the gas valve is shut off.

5. A control system as set forth in claim 4 wherein said relay actuation means comprises a microprocessor with an output to the relay.

6. A control system as set forth in claim 4 wherein said means for sensing when the power contacts of the relay are closed comprises a circuit for sensing the voltage across the power contacts.

7. A control system as set forth in claim 4 wherein said comparison means comprises a microprocessor with thermostatic input signals which may call for heat and gas valve relay contact output signals that may call for the closing of said relay contact.

8. A method of controlling a gas furnace of the type having an induced draft blower whose output is sensed by a pressure switch which is normally closed to provide power to a gas valve by way of a switch which is susceptible to being closed at a time that is outside of its norma? sequence of operation comprising the steps of:

sensing when the switch is, in fact, closed outside its normal sequence; and responsively turning off the induced draft blower to thereby open the pressure switch and cause the gas valve to move to its closed position.

9. The method as set forth in claim 8 wherein the step of sensing when the relay contacts are welded is accomplished by sensing the voltage across the relay contacts and comparing that voltage with a predetermined threshold level.

* * * * *